US006104305A

United States Patent [19]

Beckmann

[11] Patent Number: 6,104,305

[45] Date of Patent: Aug. 15, 2000

[54] POLE ALARM SYSTEM

[75] Inventor: Uwe L. Beckmann, Chapel Hill, N.C.

[73] Assignee: The Will-Burt Company, Orrville, Ohio

[21] Appl. No.: 09/165,380

[22] Filed: Oct. 2, 1998

Related U.S. Application Data

[60] Provisional application No. 60/065,803, Nov. 14, 1997.

[51] Int. Cl.[7] ..... G08B 21/00

[52] U.S. Cl. ..... 340/685; 340/686.6; 340/689

[58] Field of Search ..... 340/685, 686.1, 340/686.2, 686.6, 689, 436, 664

[56] References Cited

U.S. PATENT DOCUMENTS

| | | | |
|---|---|---|---|
| 4,064,997 | 12/1977 | Holland et al. | 340/685 |
| 4,516,117 | 5/1985 | Couture et al. | 340/685 |
| 4,649,375 | 3/1987 | Duppong et al. | 340/660 |
| 4,675,664 | 6/1987 | Cloutier et al. | 340/685 |
| 4,683,464 | 7/1987 | Lin et al. | 340/685 |
| 5,301,756 | 4/1994 | Relyea et al. | 169/24 |
| 5,481,248 | 1/1996 | Kruh | 340/685 |

*Primary Examiner*—Daniel J. Wu
*Assistant Examiner*—Van T. Trieu
*Attorney, Agent, or Firm*—Vickers, Daniels & Young

[57] ABSTRACT

A Pole Alarm System including an electromagnetic field sensor and collision sensors for detecting overhead power lines and physical obstructions within the intended path of a telescoping mast or utility boom device is disclosed. The present alarm system includes a mast-mounted housing containing the sensors and a microprocessor-based control unit which interprets the output signals of the sensors and provides both audible and control feedback to a safety control module in the vehicle to alert the operator of impending contact and to automatically stop the movement of the mast. The alarm housing also features a light source which provides illumination in the direction of movement of the mast to assist in positioning thereof. The light source also functions as a heating element to prevent the accumulation of ice on the housing which would detrimentally affect the performance of the system. The alarm housing also includes a plurality of Tilt sensors which monitor the orientation of the mast to prevent mast extension if the device deviates from an acceptable range of operation. A system integrated safety control module mounted in the vehicle provides self-test functions and an error code display to alert the operator to the cause of an alarm signal.

2 Claims, 13 Drawing Sheets

POLE ALARM SYSTEM

CROSS-REFERENCE TO RELATED APPLICATION

This Application claims the benefit under 35 U.S.C. 119(e) of U.S. Provisional Application No. 60/065,803 filed Nov. 14, 1997 by Uwe L. Beckmann and Robert U. Beckmann for Pole Alarm.

BACKGROUND OF INVENTION

Field of Invention

The present invention relates generally to alarm systems and, more particularly, to a collision avoidance alarm for a telescoping mast.

Telescoping masts of the type including a plurality of extensible, interconnected sections operated by pneumatic, hydraulic, or mechanical power are well known to those skilled in the art. For example, such telescoping masts are used extensively in the broadcast industry to elevate antennas for remote transmission of audio and video signals. Such a telescoping mast is also utilized on utility repair trucks having elongated boom including a so-called "cherry picker" that is used by public and private utility maintenance crews to reach elevated power, cable, and telephone transmission lines. Similarly, the present Pole Alarm system is also suitable for use on ladder trucks, cranes, hoists, and other related equipment.

Remote broadcast antennas mounted on telescoping masts or poles must often be rapidly deployed under severe weather conditions as might be encountered by a television or radio news crew while reporting on a natural disaster. Similarly, utility crews must elevate maintenance workers to reach and repair damage to power and telephone lines often during inclement weather and at night.

Although few problems are encountered while raising such a mast in open areas having good visibility, the maintenance workers' life and equipment is subject to an extreme risk when overhead electrical transmission lines and/or physical obstructions are encountered particularly at night or during other poor visibility conditions. In a number of instances contact with electrical wires and collisions with overhead obstructions have resulted in the injury or death of personnel and extensive damage to equipment.

Thus, there is a need for an alarm device to warn the operator of such a telescoping mast or boom type device of an impending collision with overhead power lines or other potentially dangerous obstruction before actual contact occurs. Such a warning would significantly reduce personal injuries to the operator and damage to the equipment caused by a collision.

SUMMARY OF THE INVENTION

After much study of the above described problems, the present invention has been developed to provide a Pole Alarm System which will alert the operator of a boom truck or other telescoping mast apparatus of impending contact with an overhead power line or other potentially dangerous overhead structure before actual contact occurs.

The present Pole Alarm System includes a housing which is mounted on the uppermost portion of the mast or boom to be monitored including at least two separate sensing devices capable of detecting an electrical field generated by an overhead power transmission line and of detecting physical obstructions within a specified proximity of the housing using an ultrasound transducer.

The alarm housing also includes a light source or so-called Lookup Light which illuminates the area of intended movement of the mast to enhance the operator's ability to safely control the equipment to which the alarm housing is attached.

In addition, the present alarm system includes a plurality of tilt sensors which monitor the orientation of the mast relative to a desired level condition which will prevent mast extension if it is tilted or leaning.

Upon detection of an overhead power line or physical obstruction, the Pole Alarm System provides both audible and control feedback to a control module within the vehicle to alert the operator of impending contact and to quickly stop the movement of the mast or boom.

The range of detection provided by the present alarm system is designed such that the audible alarm activates in sufficient time to permit the operator to manually halt the movement of the mast or boom and to provide a control signal to the mast's electrical controller to automatically stop movement into the hazardous zone.

In view of the above, it is an object of the present invention to provide a Pole Alarm System for use on a telescoping mast apparatus such as a utility boom truck that will warn the operator of impending contact with an overhead power line or other physical obstruction.

Another object of the present invention is to provide a Pole Alarm System having at least two separate sensor devices capable of detecting the presence of an electrical field and/or capable of detecting physical obstructions by the use of ultrasound or other technologies.

Another object of the present invention is to provide a Pole Alarm System including a light source to illuminate the area of intended movement of the mast to enhance the operator's ability to safely control the equipment.

Another object of the present invention is to provide a Pole Alarm System including tilt sensors capable of detecting the orientation of the mast relative to a level condition to ensure proper operation of the device.

Another object of the present invention is to provide a Pole Alarm System capable of providing both audible and control feedback to alert the operator of impending contact and to automatically stop movement of the mast into a hazardous zone.

Other objects and advantages of the present invention will become apparent and obvious from a study of the following description and the accompanying drawings which are merely illustrative of such invention.

DETAILED DESCRIPTION OF INVENTION

Figure 2:
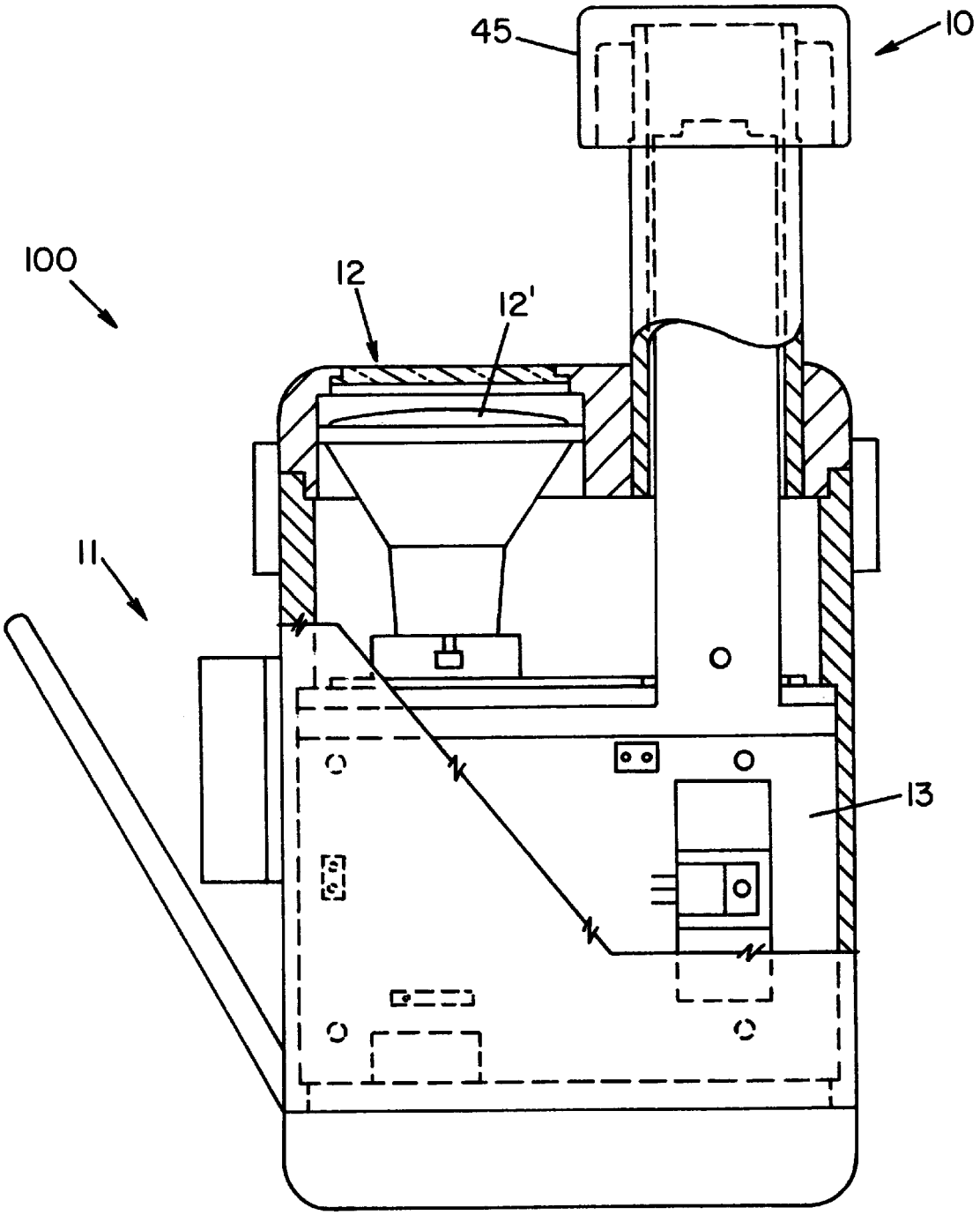
FIG. 2 is an enlarged, side elevational view of the Pole Alarm housing showing the arrangement of components therein.

With further reference to the drawings there is shown therein a view of the pole alarm housing, indicated generally at 100, disposed on a telescoping mast 26 of the type used on a boom truck. There is shown in FIG. 2 an enlarged view of the pole alarm housing 100 and the components contained therein including the AC (alternating current) detector AC detector antenna, indicated generally at 45, indicated generally at 10, the Collision detector unit, indicated generally at 11, a light source or so-called Lookup Light, indicated generally at 12 and the integrated control unit, indicated generally at 13.

Figure 1:
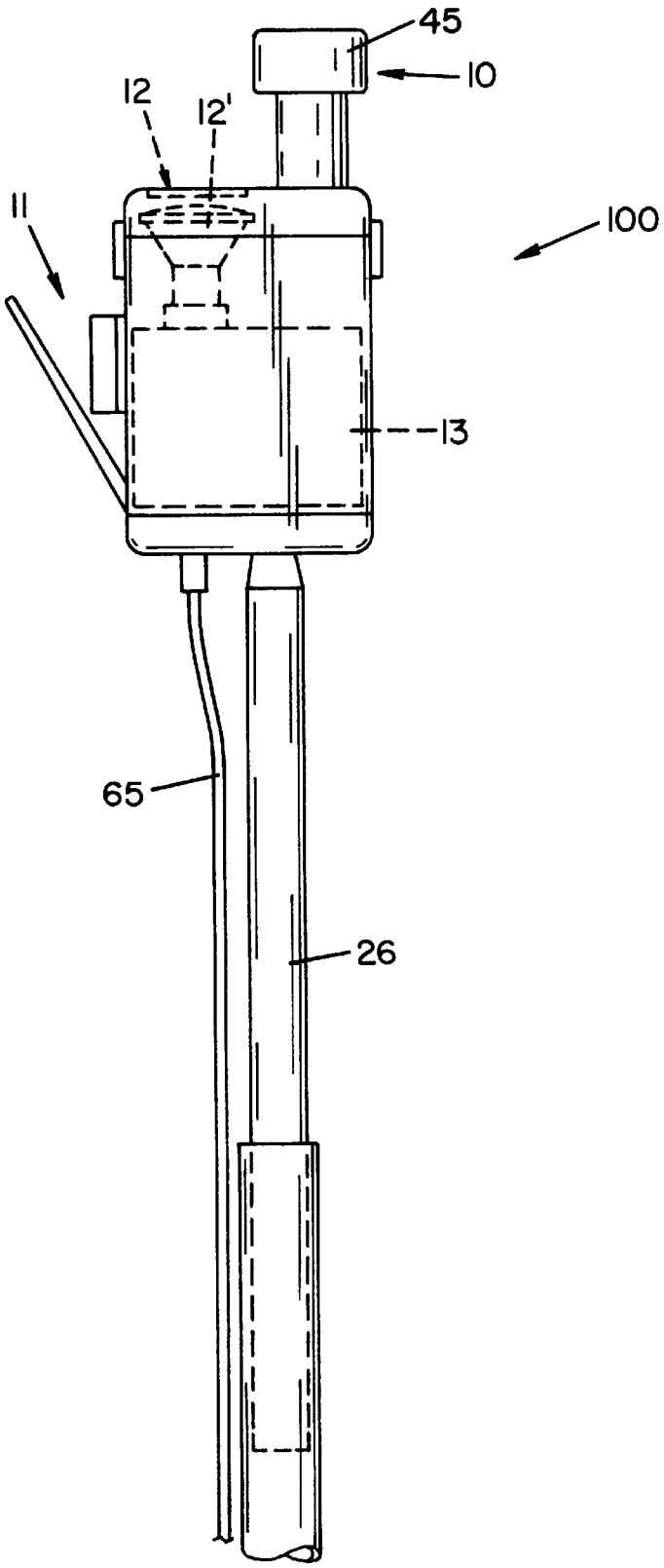
FIG. 1 is a diagrammatic view of the Pole Alarm housing of the present invention mounted on a telescoping mast structure.

It will be understood that the housing 100 must be disposed at the highest point of the telescoping mast 26 as shown in FIG. 1 and directed generally upwardly in its functional position. There must be no obstructions to either the AC detector 10 or the collision detector 11 for the present alarm system to function properly.

The AC detector antenna 45 protrudes above the housing 100. The halogen spotlight bulb 12' of the Lookup Light 12 is located within the housing 100 for protection. The Collision Detector 11 is side mounted. The Control Unit 13 is located inside the housing 100 to shield and protect the circuitry from the environmental elements. The Tilt sensors 59 are mounted in the Control Unit 13 circuit board.

In an alternative embodiment (not shown) multiple AC and Collision Detectors 10 and 11 as described hereinabove are positioned to provide detection of an electrical power line or a physical obstruction in any one of three axes relative to the housing.

Figure 3:
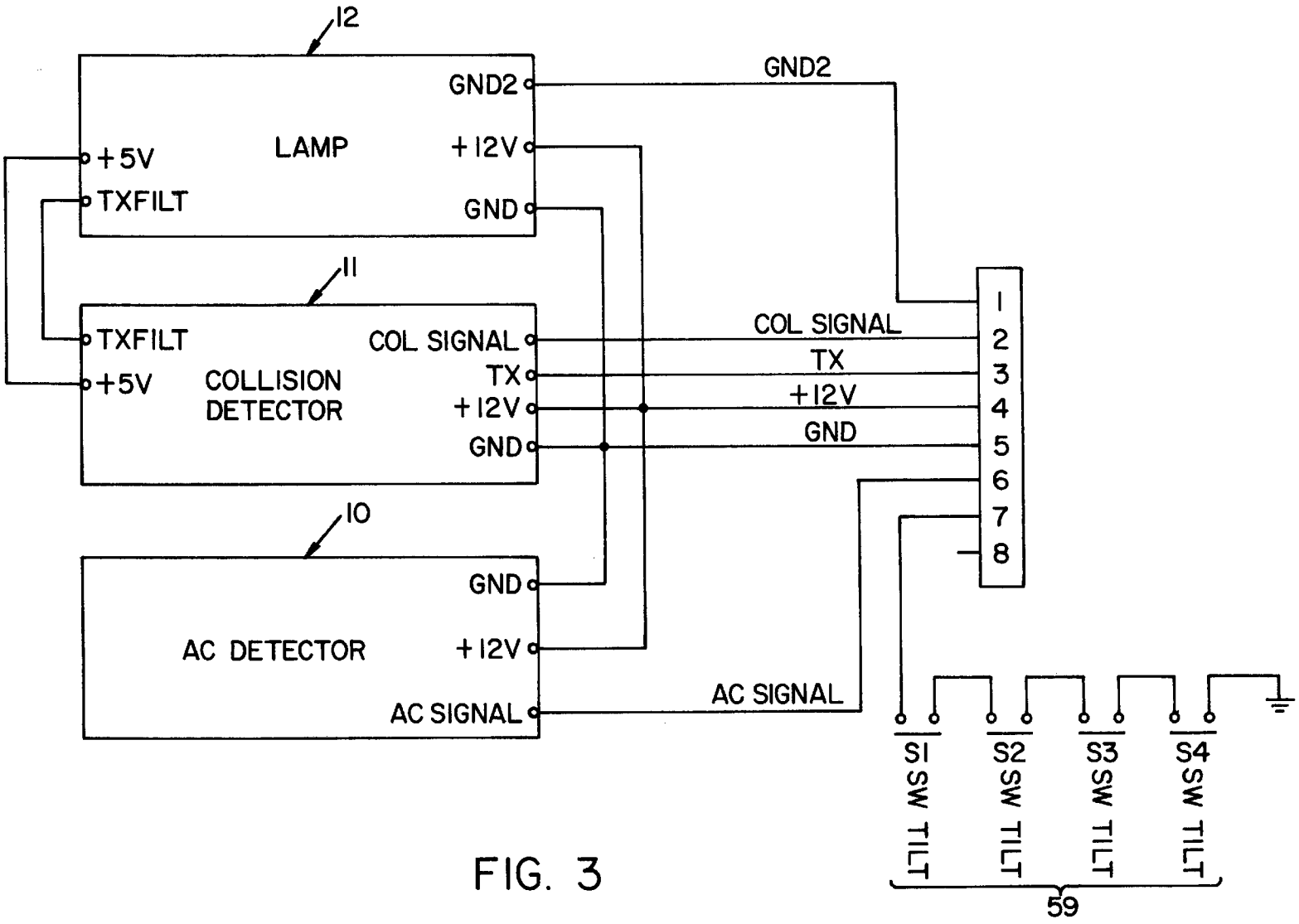
FIG. 3 is a schematic diagram showing the circuitry interconnecting the AC detector, the Collision Detector, the Lookup Light and the tilt sensors of the present alarm system.

Referring now to FIG. 3 there is shown therein a schematic diagram of the control circuitry for the AC detector antenna 10, the Collision detector 11, and the lookup light 12. Also illustrated in FIG. 3 are the tilt sensors 59 which are located in the housing 100.

Figure 4:
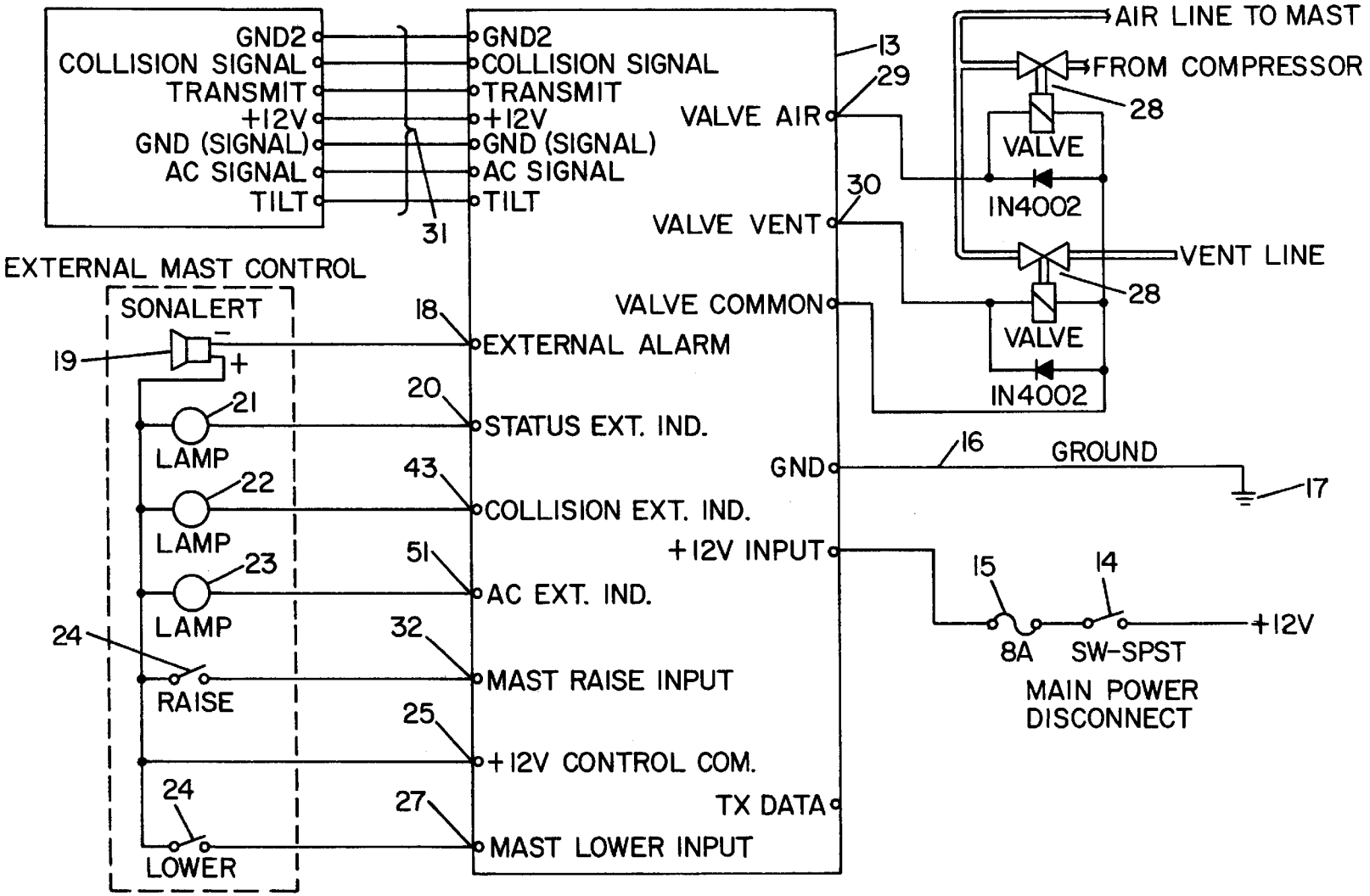
FIG. 4 is a schematic diagram showing the interconnection of the Pole Alarm system's circuitry to the external audible alarm, lamps, switches, and valves.

Referring now to FIG. 4, the control unit 13 is connected to +12 Volts (DC) through a main power disconnect switch 14 and fuse 15. A second power lead 16 connects to the vehicle ground 17.

The audio External Alarm output 18 applies a signal to the audible device 19, which in this case illustrated as a piezoresonator upon the detection of a possible safety hazard.

The Status External Output 20 operates a lamp 21 to provide an indication of the status of the alarm. A second lamp 22 is lit by the signal from the Collision external output 43 upon detection of an object with which the mast or boom is about collide. A third lamp 23 is lit by the signal from the AC External output 51 upon detection of the presence of a high voltage line.

The audible device 19, the lamps 21, 22, 23, and external switches 24 are each connected to a common +12 Volts (DC) output Control Corn. 25. on the control unit 13. The external switches 24 are connected to the Mast Raise input 32 and Mast Lower input 27 to control the movement of the mast or boom 26.

When switches 24 are activated, the corresponding pneumatic or hydraulic valve 28 associated with the mast or boom 26 and connected to the Valve Air Output 29 and the Valve Vent Output 30 are energized as appropriate to raise or lower the mast or boom.

The control system as described hereinabove also permits the Control Unit 13 to override the manual operation of the mast or boom 26 and halt the movement thereof before a hazardous power line or obstruction is contacted. The Control Unit 13 connects through multiple signal conductors 31 to the AC detector 10 and the Collision detector 11.

Figure 5A:
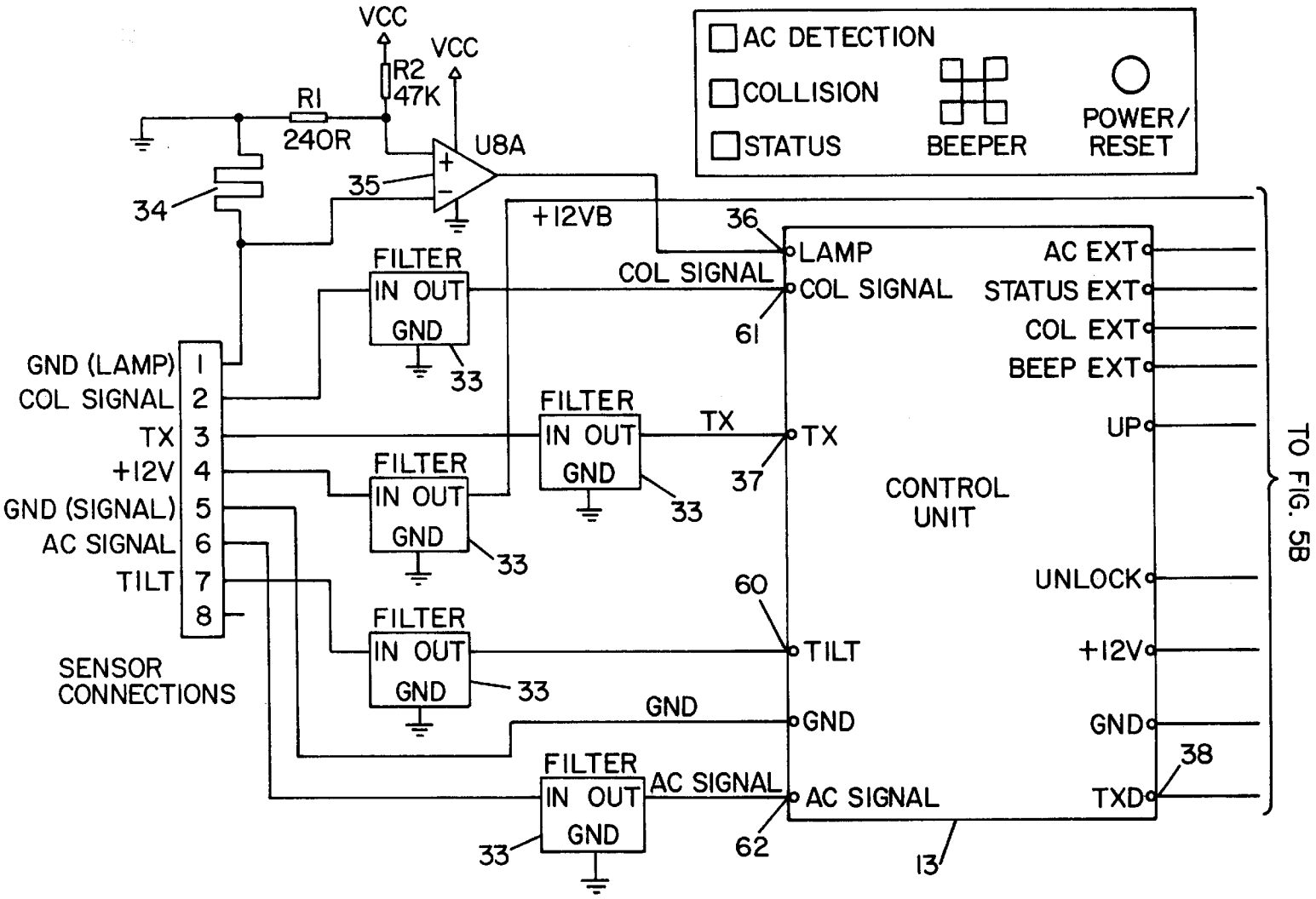
FIGS. 5A and 5B are schematic diagrams showing the interconnection of the microprocessor circuit board to the components in the alarm housing.
Figure 5B:
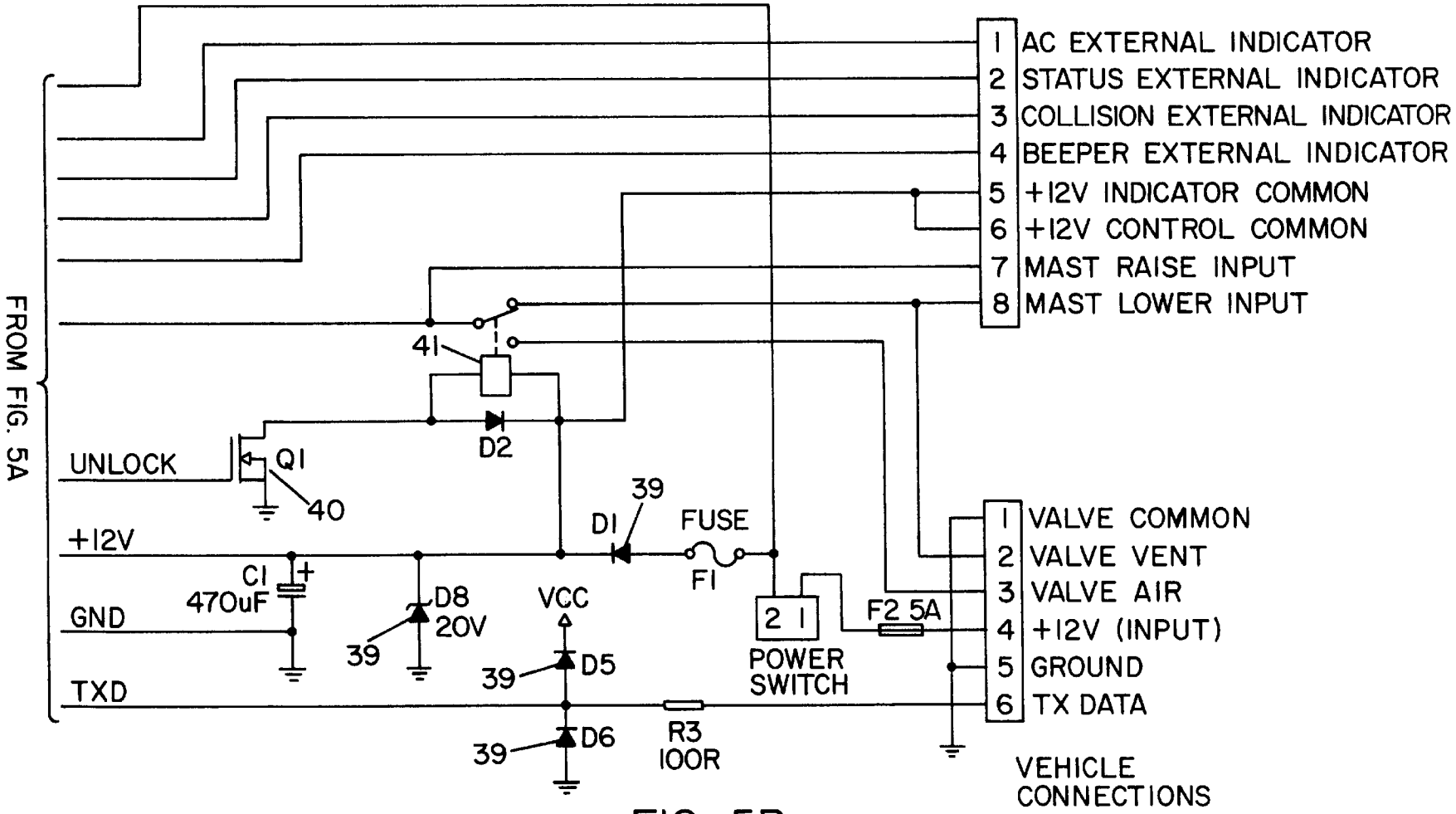

Referring now to FIGS. 5A and 5B there are shown therein a more detailed diagram of the interconnection of the Control Unit 13 with the AC detector 10, the Collision detector 11 and the Tilt sensors 59 of FIG. 3 and the valves 28 of FIG. 4.

As illustrated in FIG. 5A EMI filters 33 are provided on each signal input i.e. COL signal 61, TX 37, TILT 60, and AC signal 62 to the Control Unit 13 to minimize detection of the false electrical signals.

Also shown in FIG. 5A is a temperature sensing element 34 with its associated voltage comparator 35 which is configured to signal the Control Unit 13 when the ambient temperature of the alarm housing 100 exceeds a predetermined level.

The voltage comparator 35 is connected to a LAMP input 36 on the Control Unit 13. Serial communications data are received by the Control Unit 13 on the TX input 37 and transmitted on the TxD output 38.

Zener and standard diodes 39 are provided to protect the Control Unit 13 from damage resulting from excessive or reverse polarity voltages inadvertently applied to the Control Unit 13.

A MOS field-effect transistor (MOSFET) 40 in FIG. 5B is utilized to interface the Control Unit 13 to the relay 41 which, in turn, provides control voltage to the external pneumatic or hydraulic valves 28. The status of the Tilt sensors 59 is monitored through the Tilt input 60.

Figure 6:
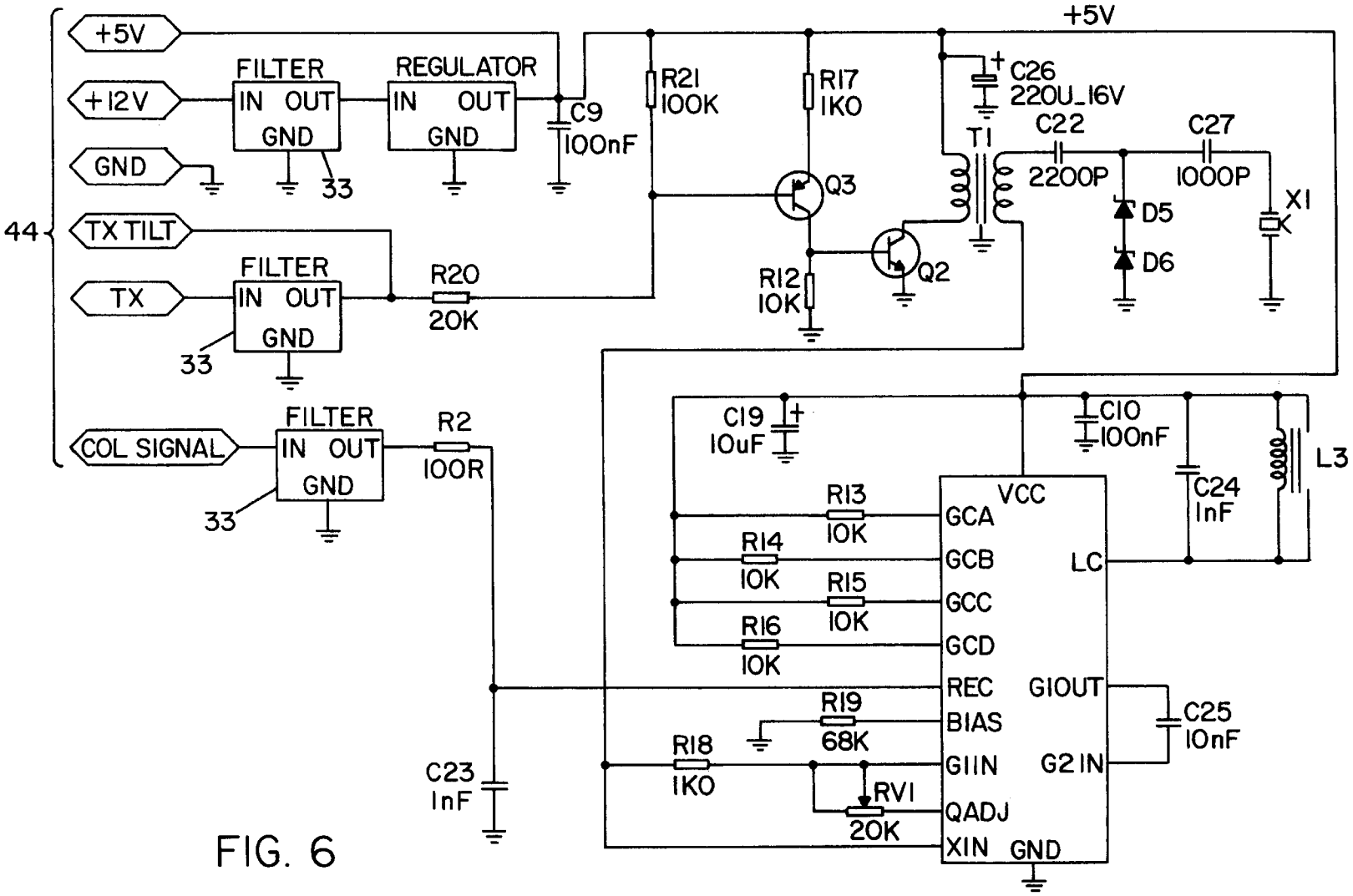
FIG. 6 is a schematic diagram of the Collision Detector of the present system showing the components and circuitry thereof.

Referring now to FIG. 6 there is shown therein a preferred embodiment of the control circuitry for the ultrasonic Collision detector 11. The output from the Collision detector 11 is connected to the TX, TXTILT, +5 V, and COL signal terminal connector indicated generally at 44. The ultrasonic collision detector 11 detects objects that are within 1 to 8 feet of the alarm housing 100 and outputs a control signal to the vehicle's mast control device (not shown) to halt the movement of the mast.

Since such ultrasonic collision detectors as a separate device are well known to those skilled in the art, further detailed discussion of the same is not deemed necessary.

Figure 7:
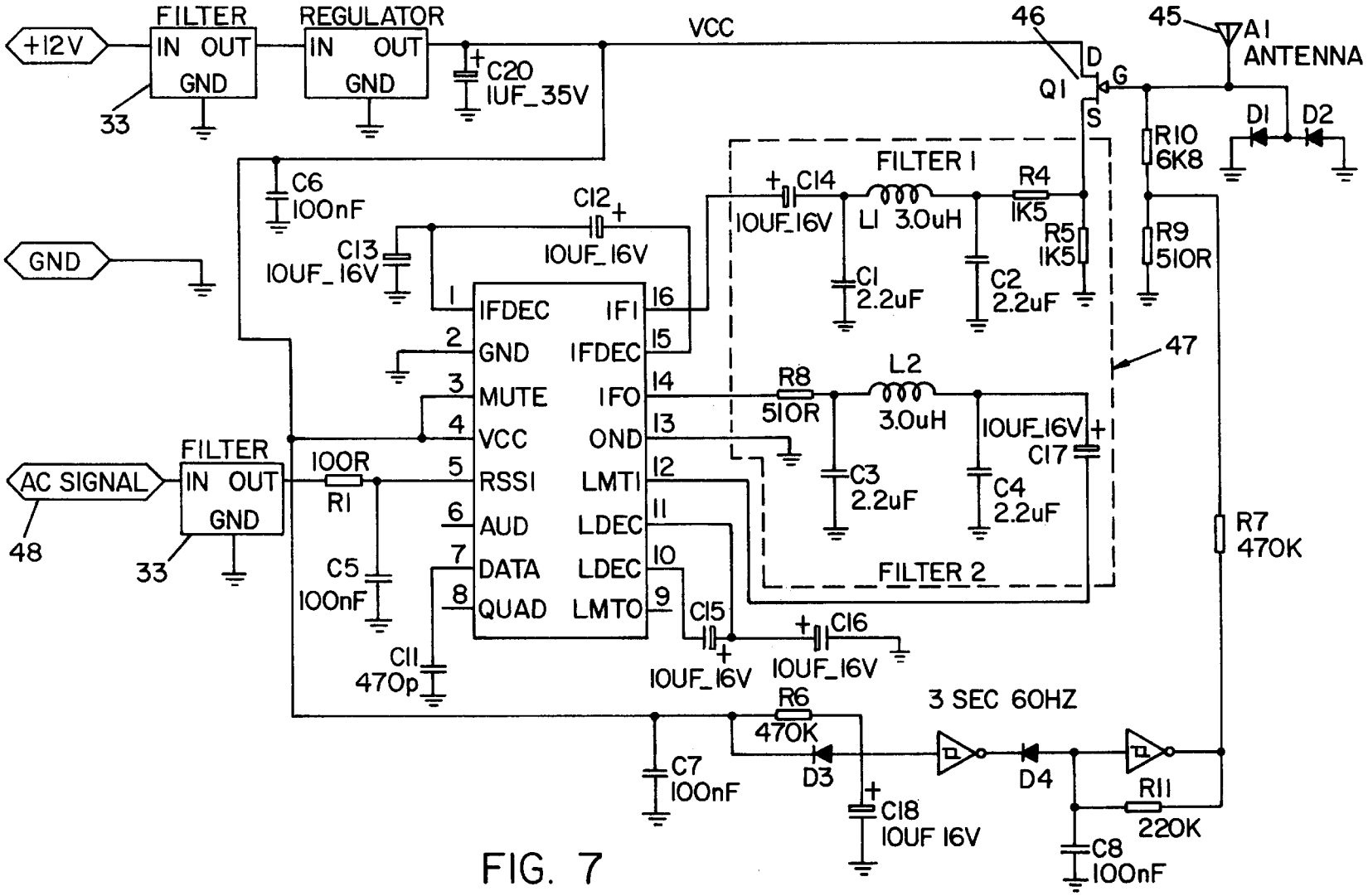
FIG. 7 is a schematic diagram of the AC detector of the present invention showing the components and circuitry thereof.

Referring now to FIG. 7 there is shown therein a schematic diagram of the AC detector 10 of the present alarm system. The AC detector 10 detects the presence of AC (alternating current) voltage through its associated antenna 45. Such electrostatically induced signal is amplified by a force-effect transistor (FET) 46 and filtered by multiple stages of filtering circuitry, indicated generally at 47.

In the preferred embodiment the AC detector 10 is capable of sensing the presence of a 7200 Volt 60 Hertz electrical transmission line at a minimum distance of 8 feet. This distance is sufficient to provide ample warning for the operator of the mast or boom to halt the travel thereof towards the power line or to provide an electrical signal to the mast positioning control device (not shown) of the vehicle to automatically stop the movement of the mast thereby avoiding a collision. The output from the AC detector 10 is interconnected to the Control Unit 13 through the AC signal terminal 48.

Figure 8:
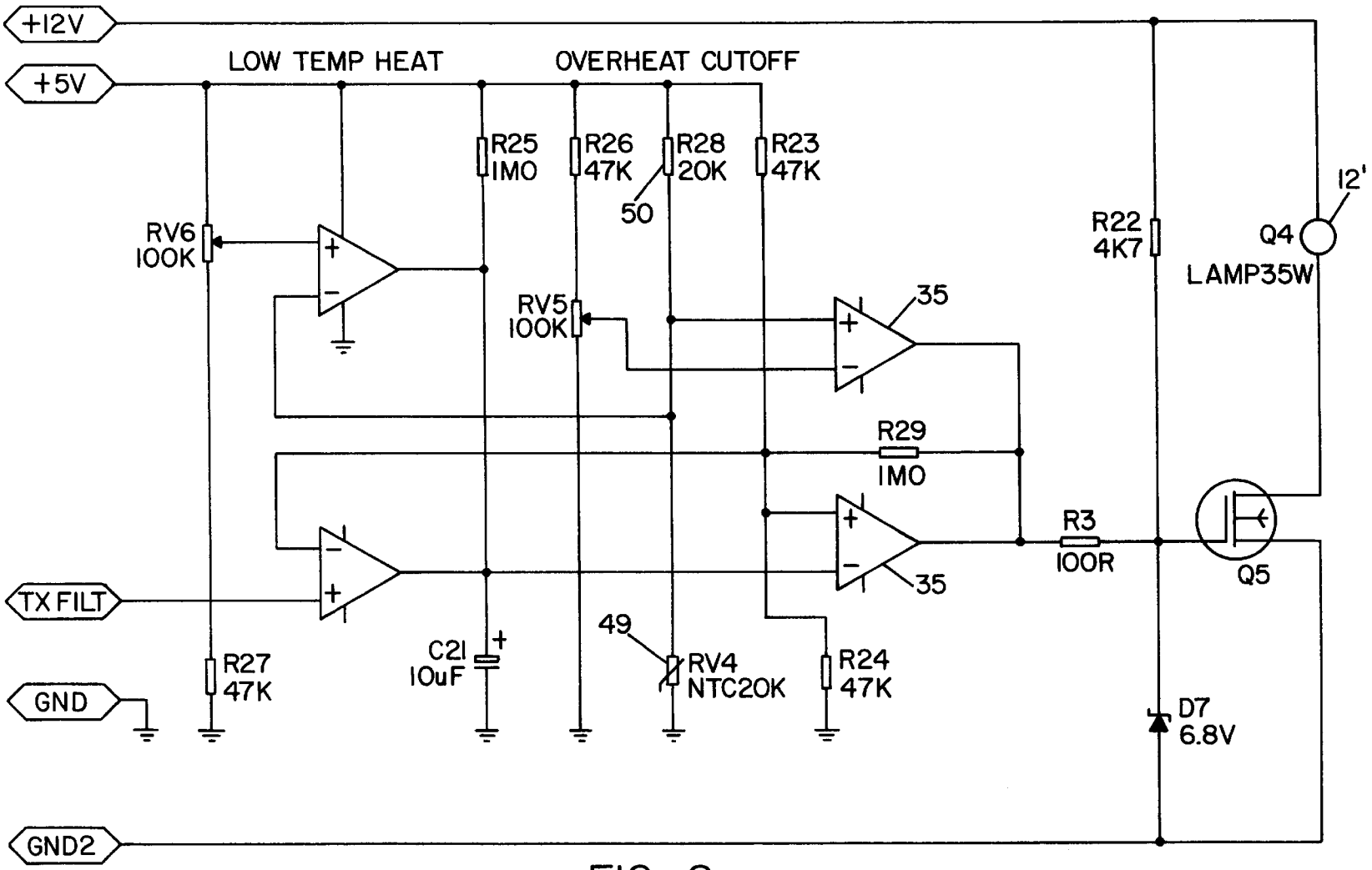
FIG. 8 is a schematic diagram of the control circuitry and components of the Lookup Light of the present alarm system.
Figure 9A:
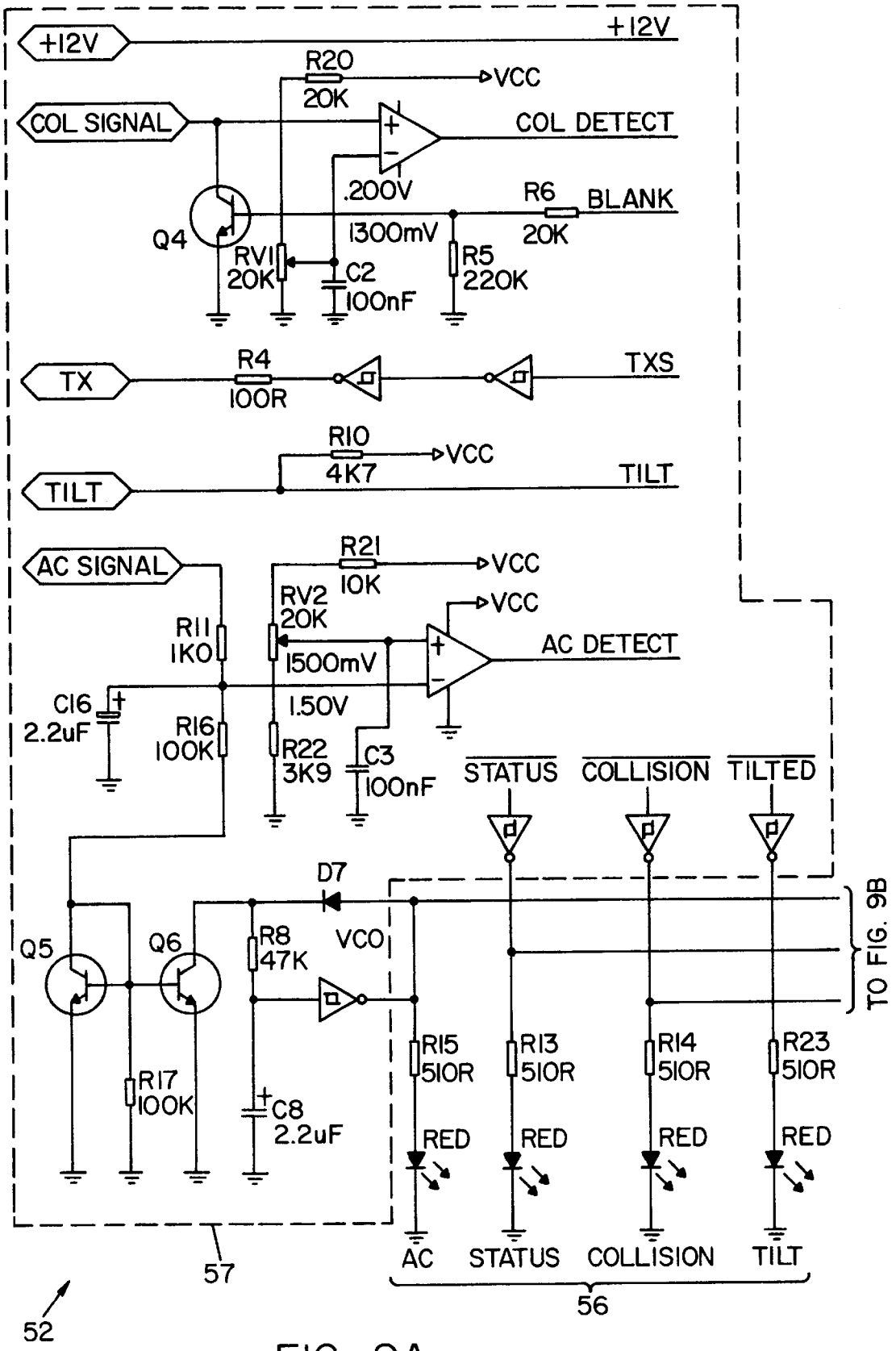
FIGS. 9A–9D are a schematic diagrams of the microprocessor circuit board of the present alarm system.
Figure 9B:
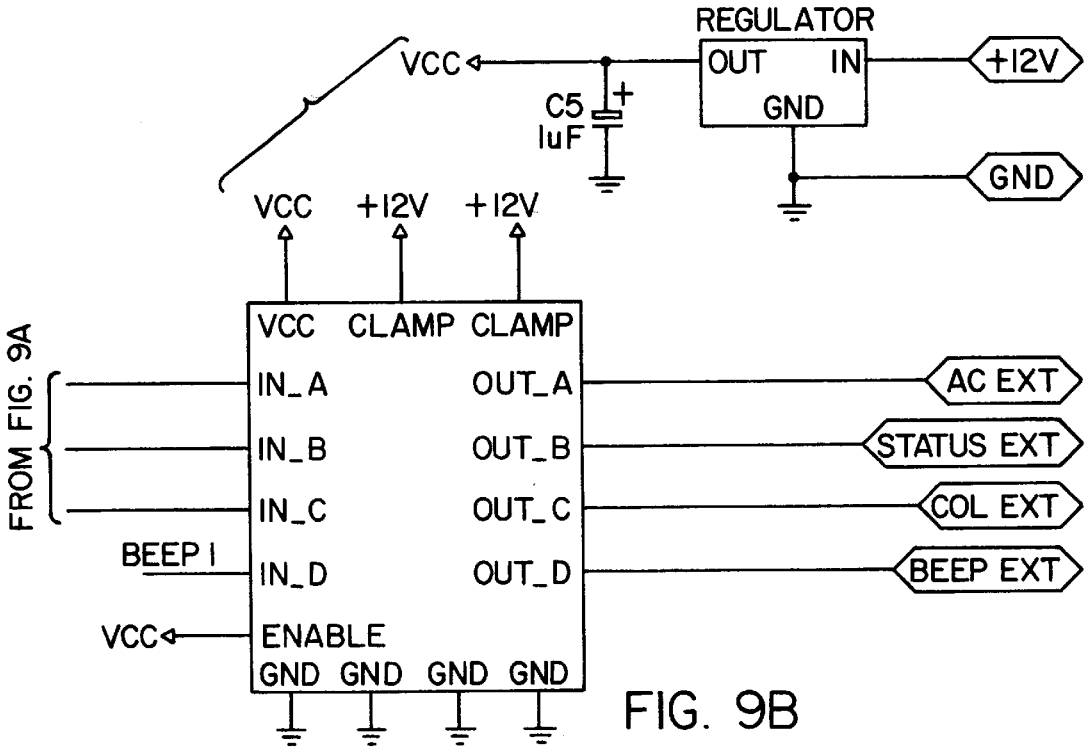
Figure 9C:
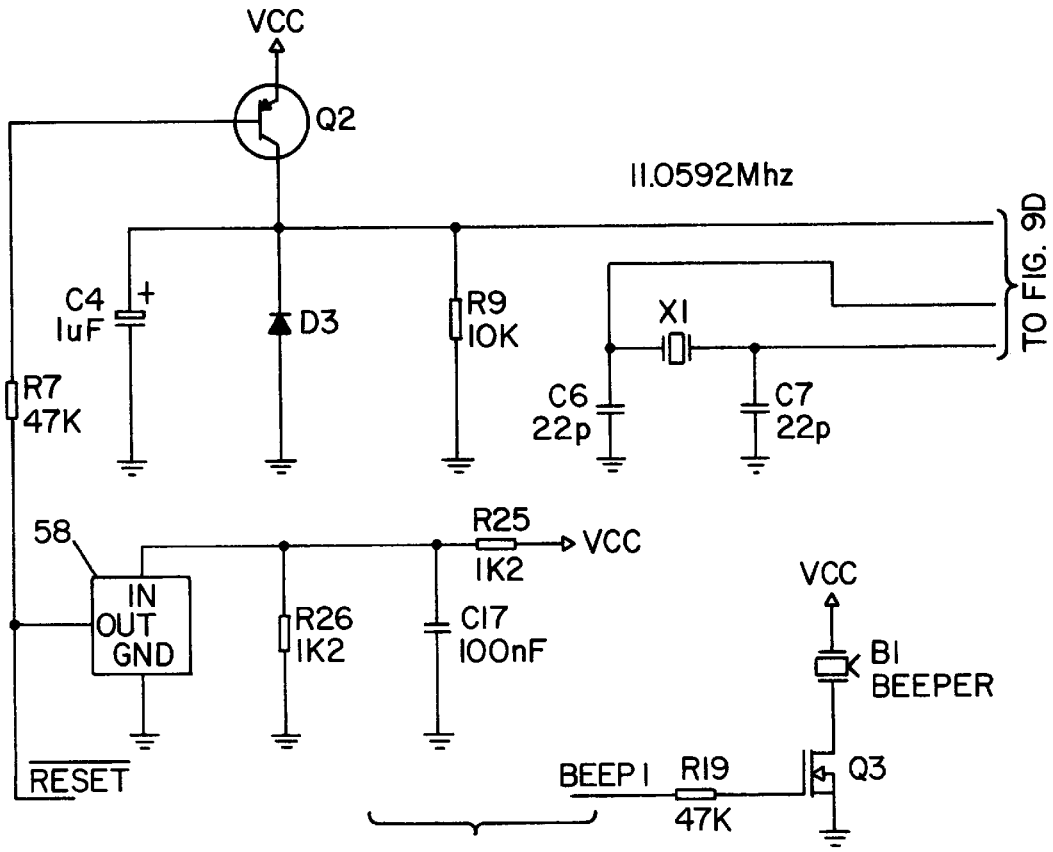
Figure 9D:
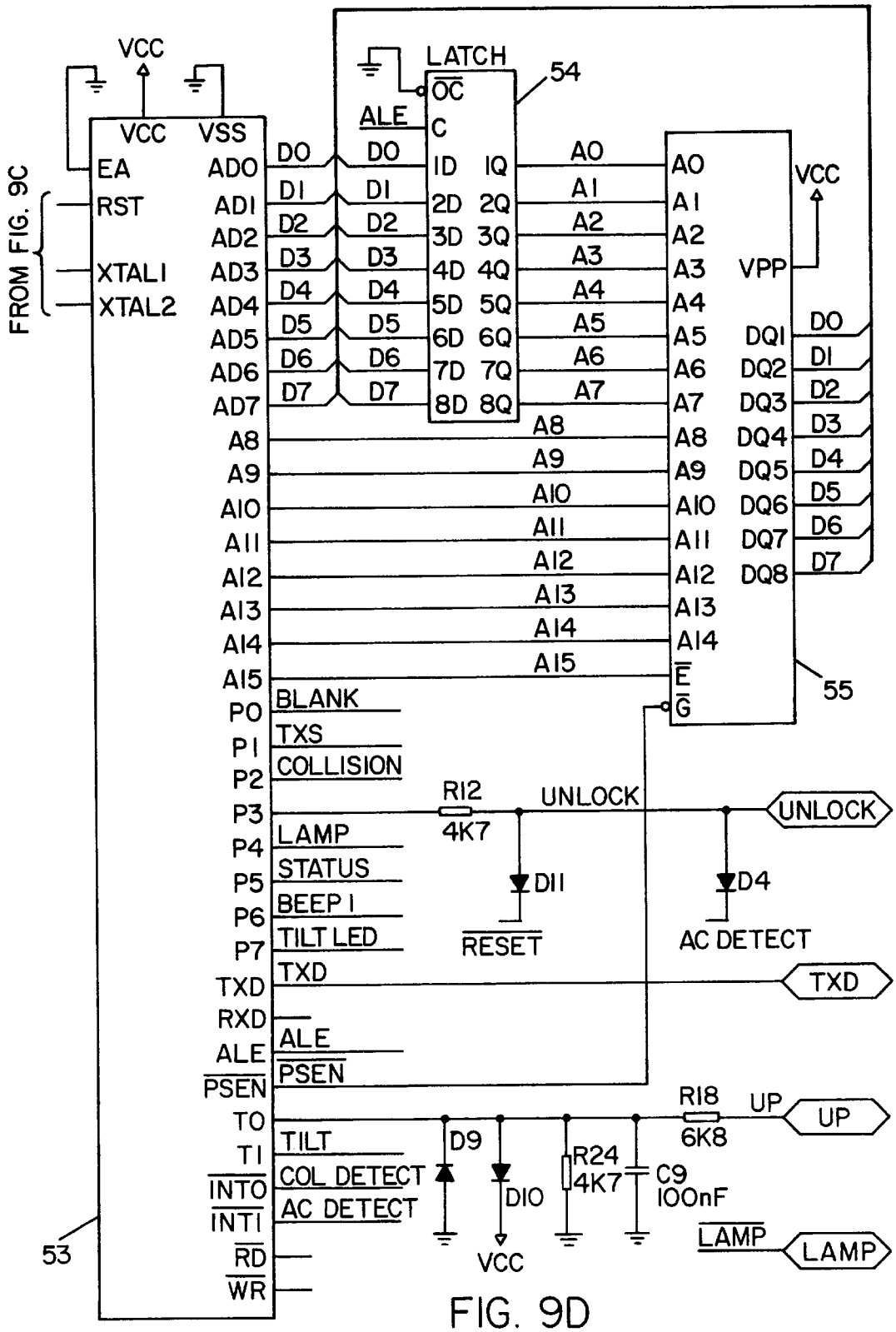

Control of the Lookup Light 12 is accomplished with the circuitry illustrated in FIG. 8. A negative temperature coefficient (NTC) device 49 responds to the ambient temperature within the alarm housing 100. The voltage resulting from voltage division between a thermally stable resistor 50 and the NTC device 49 is monitored with a pair of voltage comparators 35 in a window configuration.

If the ambient temperature drops below a predetermined threshold level, as would occur with icing of the alarm housing 100, the Lookup Light 12 illuminates and serves as a heater element thereby melting the ice and keeping the present system operational. Should the ambient temperature rise above a second predetermined threshold level, as would occur with prolonged operation of the halogen light, the Lookup Light 12 extinguishes to permit the housing 100 to cool before being damaged by excessive heat.

Upon detection of an electrical or physical obstruction within the range of either sensor, audible and visible alarms are activated to alert the person operating the mast positioning system of the imminent collision. The Lookup Light 12 functions to provide illumination to assist the operator in guiding the mast to a safe position.

Referring now to FIGS. 9A–9D, a microprocessor circuit board, indicated generally at 52, provides interpretation of and response to signals generated by the AC detector 10 and the collision detector 11. In the preferred embodiment, this conventional microprocessor configuration includes an 8031-type microprocessor 53, an external CMOS latch 54, and an erasable programmable read-only memory-55.

Because the microprocessor 53 and its associated circuitry are low voltage, low current devices, they are unable to directly drive external relays, valves, or other higher current devices. Interconnection and proper drive levels are achieved with an array of additional transistors, indicated generally at 57, as shown.

Visual status indications i.e. (AC, STATUS, COLLISION, TILT) are provided by light emitting diodes 56.

Power-on reset for the microprocessor 53 is provided by a watchdog circuit 58 specifically designed to monitor the operating voltage of the microprocessor circuit board 52 and reset the microprocessor 53 as necessary to start and maintain reliable operation.

The basic operation of the Pole Alarm System and the operating relationships of the respective sensors will now be described. In order to operate the present alarm system, the housing 100 containing the sensors is installed at the highest point of the mast or boom using suitable attaching hardware such that the AC detector 10 projects upwardly as shown in FIG. 1. It is critical to the operation of the present system that there be no obstructions to either the AC detector antenna 45 or the Collision detector 11 which projects from the side of the housing 100.

Figure 10:
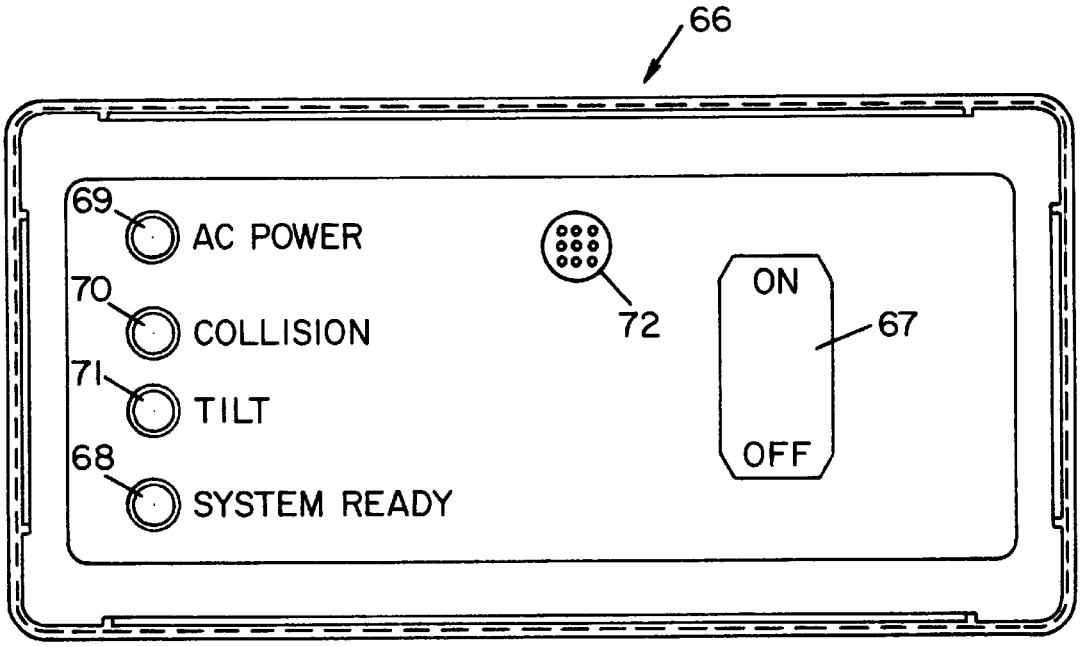
FIG. 10 is a front elevational view of the safety control module of the present system.

A 6-conductor shielded cable 65 not to exceed 100 feet in length and a wire gauge no smaller than 16 gauge is utilized to connect the Pole Alarm housing 100 to the safety control module, indicated generally at 66 as shown in FIG. 10, which is mounted inside the vehicle. The safety control module 66 should be mounted to allow the operator an unobstructed view of the warning indicators 68–71 while operating the mast.

Of course, the switches for extension and retraction of the mast for movement of the boom as well as the control valves should be wired as specified in the vehicle wiring schematic.

The Pole Alarm System requires 12.6 Volts DC nominal (actual 10.6 Volts to 20 Volts) at a maximum current not to exceed 5 amperes. A fuse-protected circuit of 8 amperes should be provided.

Even though the Pole Alarm has robust noise filtering on its power input circuitry, some installations with extreme electrical noise from other devices may necessitate additional filtering of the power input. Since installations vary considerably from vehicle to vehicle, it is the installer who must verify proper operation of the safety control module 66 under all conditions.

After installation of the Pole Alarm System is completed, power is turned on using the main power switch 67 on the safety control module 66. The present system is designed to perform a comprehensive system self-test requiring approximately 8 seconds. When the self-test is complete and passes, the Ready Status indicator 68 will glow "green" continuously. This visual indicator signifies that the system appears to be working properly and that extension of the mast or boom may proceed.

If the self-test fails, an error indicating code will be displayed by the System Ready indicator 68. The failure codes are as follows:

| | |
|---|---|
| 1 blink every 10 seconds | AC detector failure |
| 2 blinks every 10 seconds | AC detector failed to clear |
| 3 blinks every 10 seconds | collision detector failure |
| 4 blinks every 10 seconds | collision detector failed to clear |
| 5 blinks every 10 seconds | extend switch failure |

Assuming the self-test passes, the Pole Alarm System is in a monitoring status. The mast-mounted Lookup Light 12 will be illuminated and there may be an occasional flash of the AC power indicator 69 on the control unit. The rate at which the AC power indicator 69 flashes is a measure of the signal strength of a nearby AC power source. After making a thorough inspection of the overhead and surrounding area, the mast or boom 26 may be extended using the vehicle's mast controls (not shown).

If during the monitoring state the present Pole Alarm senses a possible collision or a dangerous AC electric field, an alarm condition is triggered. The safety control module 66 will sound an audible alarm via speaker 72 and will show the operator the cause of the alarm condition. A rapidly flashing AC power indicator 69 signifies the presence of a strong AC electric field. A flashing Collision indicator 70 signifies a possible collision with a power line or other physical obstruction. A flashing Tilt indicator 71 indicates an unbalanced condition of the mast or an unlevel condition of the vehicle or both.

During either alarm condition a further extension of the mast or boom is automatically blocked, and the System Ready indicator 68 goes dark. If after 5 seconds the offending alarm condition is removed, extension of the mast is again allowed. Of course, it is possible to retract the mast or boom at any time during operation.

If no alarms occur and if no further attempt to raise the mast or boom for approximately 15 minutes, the present alarm system will enter a resting state. AC monitoring will continue; however, the Lookup Light 12 will turn off and the operation of the Collision detector 11 will cease.

During situations of extreme cold, the mast-mounted Lookup Light 12 may illuminate whenever the main power switch is in the "on" position. This illumination will help to minimize ice or snow buildup on the alarm housing 100 by raising the temperature thereof. The AC detector 10 and the Collision detector 11 must be kept free of ice and snow for proper operation.

Conversely, prolonged operation of the mast-mounted Lookup Light 12 may cause the alarm housing 100 to become overheated, in which case the Lookup Light 12 will be automatically disabled. The light 12 will again be eliminated when the alarm housing's temperature returns to a predetermined normal operating temperature. However, at no time should the AC power or Collision warnings be affected.

From the above it can be seen that the Pole Alarm System of the present invention provides an improved measure of safety for the operator of a telescoping mast or boom truck or other related equipment by providing both audible and control feedback to alert the operator of impending contact with dangerous overhead power lines or physical obstructions.

The range of detection provided by the alarm system is designed such that the audible alarm activates in sufficient time to cause the operator to manually halt the movement of the mast or boom and to provide a control signal to automatically stop the movement of the mast into the hazardous zone.

The terms "upper", "lower", "side" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A Pole Alarm system for use in combination with a telescoping mast apparatus, said alarm system serving to alert an operator of said mast apparatus of the presence of overhead power lines and physical obstructions, said system comprising:

an electromagnetic field sensor capable of detecting the presence of an alternating current voltage within a predetermined proximity and of generating an output signal in response thereto;

a collision detector capable of sensing the presence of a physical structure within a predetermined proximity thereto and of generating an output signal in response thereto;

a microprocessor electrically connected to said field sensor and to said collision detector and capable of interpreting said output signals and generating control signals to warning indicators and operating controls of said mast to interrupt the movement thereof prior to contact with high voltage lines and physical obstructions;

a safety control module electrically connected to said microprocessor for display of said warning indicators to an operator of said mast apparatus of impending contact with power lines and physical obstructions, said field sensor, said collision detector, and said microprocessor being disposed in a housing mounted at the uppermost position of said mast apparatus, a light source mounted in said housing and directed upwardly to illuminate the intended path of said mast apparatus during operation thereof at night time and in other conditions of poor visibility; and said light source including a halogen bulb capable of heating said alarm housing during inclement weather to maintain a predetermined operating temperature thereof.

2. A Pole Alarm system for use in combination with a telescoping mast apparatus, said alarm system serving to alert an operator of said mast apparatus of the presence of overhead power lines and physical obstructions, said system comprising:

an electromagnetic field sensor capable of detecting the presence of an alternating current voltage within a predetermined proximity and of generating an output signal in response thereto;

a collision detector capable of sensing the presence of a physical structure within a predetermined proximity thereto and of generating an output signal in response thereto;

a microprocessor electrically connected to said field sensor and to said collision detector and capable of interpreting said output signals and generating control signals to warning indicators and operating controls of said mast to interrupt the movement thereof prior to contact with high voltage lines and physical obstructions; and a safety control module electrically connected to said microprocessor for display of said warning indicators to an operator of said mast apparatus of impending contact with power lines and physical obstructions, said field sensor, said collision detector, and said microprocessor being disposed in a housing mounted at the uppermost position of said mast apparatus; and a plurality of tilt sensors electrically connected to said microprocessor and capable of detecting the physical orientation of said mast apparatus to prevent its deployment in a hazardous manner.

* * * * *